US007125221B2

(12) United States Patent
Dorsch et al.

(10) Patent No.: US 7,125,221 B2
(45) Date of Patent: Oct. 24, 2006

(54) CENTRIFUGAL PUMP IMPROVEMENTS

(75) Inventors: Glenn Dorsch, Aberdeen, WA (US); Kent H. Keeran, Elma, WA (US); Arne E. Swenson, Cosmopolis, WA (US)

(73) Assignee: Vaughan Co., Inc., Montesano, WA (US)

( * ) Notice: Subject to any disclaimer, the term of this patent is extended or adjusted under 35 U.S.C. 154(b) by 724 days.

(21) Appl. No.: 10/117,981

(22) Filed: Apr. 5, 2002

(65) Prior Publication Data

US 2002/0146319 A1 Oct. 10, 2002

Related U.S. Application Data

(63) Continuation of application No. PCT/US00/27778, filed on Oct. 6, 2000.

(60) Provisional application No. 60/158,014, filed on Oct. 6, 1999.

(51) Int. Cl.
*F04D 29/70* (2006.01)

(52) U.S. Cl. ..... 415/121.1; 415/169.1; 415/206; 241/46.11; 241/89.3

(58) Field of Classification Search ..... 415/121.1, 415/121.2, 169.1, 206; 241/46.06, 46.08, 241/46.11, 89.3, 185.6
See application file for complete search history.

(56) References Cited

U.S. PATENT DOCUMENTS

| | | | |
|---|---|---|---|
| 4,052,133 | A | 10/1977 | Yeater |
| 5,149,248 | A | 9/1992 | Cramer |
| 5,256,032 | A | 10/1993 | Dorsch |
| 5,810,553 | A | 9/1998 | Pedersen |

OTHER PUBLICATIONS

International Preliminary Examination Report, International Application No. PCT/US00/27778, Glenn Dorsch et al., filed Oct. 6, 2000.

*Primary Examiner*—Christopher Verdier
(74) *Attorney, Agent, or Firm*—Christensen O'Connor Johnson Kindness PLLC

(57) ABSTRACT

An improved mechanism is provided for adjusting the clearance between the outer edges of impeller vanes of a centrifugal pump and the interior surface of an adjacent intake plate. The impeller having the vanes is mounted as an assembly to a back plate that can be secured to a casing or housing to which the intake plate is mounted. Threaded adjusters allow adjustment of the clearance between the impeller vanes and the intake plate. Additional modifications include a modified seal design to prevent material from clogging relatively rotatable seal components, a modified intake plate with a shallow recess to increase chopping effectiveness and pump efficiency, impeller vanes with a unique shape to achieve a high head, and a self-priming pump.

9 Claims, 13 Drawing Sheets

CENTRIFUGAL PUMP IMPROVEMENTS

CROSS-REFERENCE TO RELATED APPLICATIONS

This application is a continuation of international application No. PCT/US00/27778, filed on Oct. 6, 2000, published in English on Apr. 12, 2001, designating the United States, and claiming the benefit of U.S. provisional application No. 60/158,014, filed on Oct. 6, 1999.

FIELD OF THE INVENTION

The present invention relates to a centrifugal pump, and particularly to a centrifugal pump effective for pumping liquids and slurries containing solid matter.

BACKGROUND OF THE INVENTION

U.S. Pat. No. 5,460,482 discloses a centrifugal chopper pump designed for pumping liquids and slurries containing solid matter, including various types of refuse, and for chopping the solid matter which may thereafter be processed for disposal. The pump has external and internal cutters rotated with the internal pump impeller. The impeller has blades or vanes that sweep across arcuate intake apertures for a slicing action of solid matter in the liquid or slurry being pumped. This patent also describes other U.S. and foreign patents that disclose pumps having blades or vanes cooperating with edges of inlet apertures for a chopping or slicing action, or external booster propellers or external cutters, including external blades that sweep across small intake apertures to dislodge or cut solid material clogging an aperture.

Depending on the material being pumped, there still may be problems with solid material working its way between cooperating parts of a pump seal, or becoming wrapped around rotating components of the pump, including the pump drive shaft. Some materials are not completely cut effectively in the known designs, and pumps designed for slicing or chopping solid materials may have a loss of efficiency or lower head as compared to units designed for pumping only liquid. There also is a need for an effective self-priming pump, particularly in the field of chopper pumps. Further, chopper pumps are subject to more wear in the area of the exposed edges of the impeller vanes and, therefore, require adjustment of the distance from the vane edges to an adjacent intake plate. In known designs, this adjustment can require removal of the intake plate and changing the clearance by the use of shims.

SUMMARY OF THE INVENTION

The present invention provides improvements for centrifugal pumps and particularly centrifugal chopper pumps for pumping liquids and slurries containing solid matter. In one aspect of the present invention, a modified seal design helps to prevent material from advancing toward relatively rotatable seal components. In another aspect of the invention, modifications are made in the pump intake plate to increase chopping effectiveness and pump efficiency. In another aspect of the invention, an impeller having vanes with a unique shape are provided to achieve improved suction lift. In another aspect of the invention, a self-priming pump is provided. A further aspect of the present invention is the provision of a centrifugal pump having an improved mechanism for adjusting the clearance between the outer edges of the impeller vanes and the interior of an adjacent intake plate.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
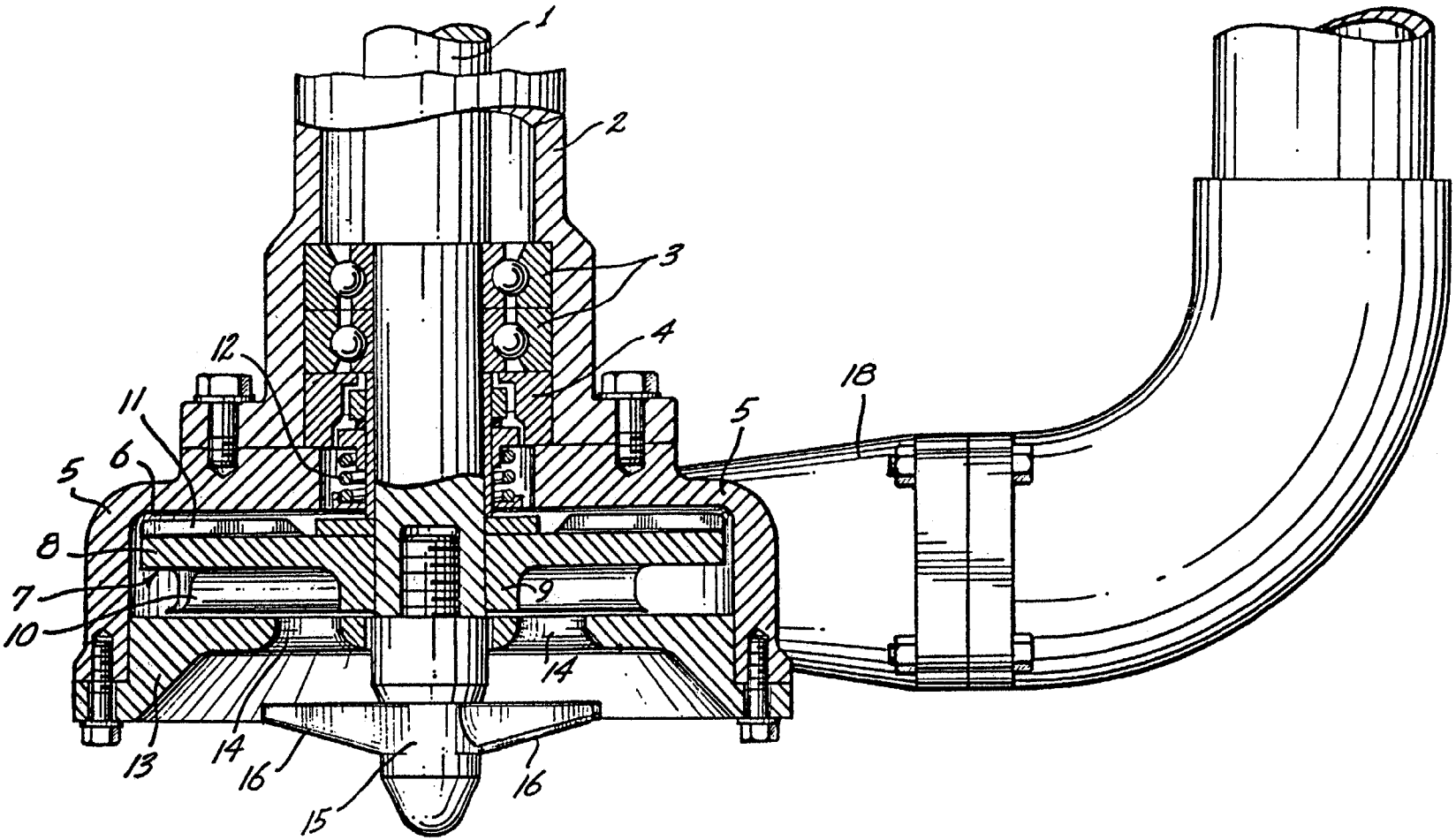
Fig. 1. (PRIOR ART)
FIG. 1 (prior art) is a fragmentary side elevation of a centrifugal pump of the general type with which the present invention is concerned, with parts broken away, and FIG. 2 (prior art) is a bottom plan thereof.
Figure 2:
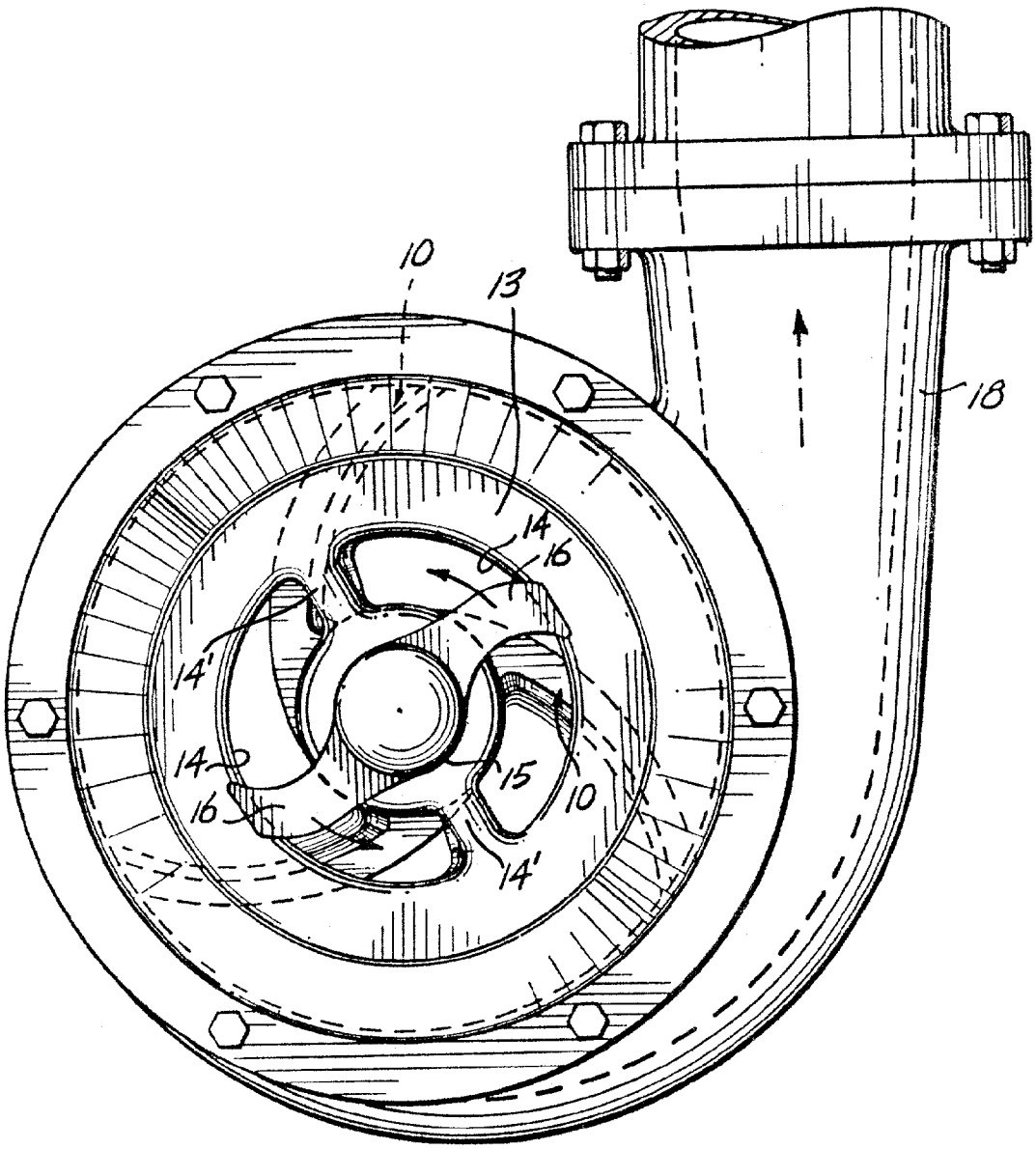
Fig. 2. (PRIOR ART)

FIG. 1 and FIG. 2 show a centrifugal pump of the general type with which the improvements of the present invention may be used. As indicated in FIG. 1, the pump includes an upright drive shaft 1 received within a column 2 forming a reservoir for oil or other lubricant. The bottom of the reservoir is closed by conventional anti-friction bearings 3 and a seal 4 which includes a spring 12. The bottom portion of the column 2 is bolted to a pump casing 5 having a downward opening cavity or bowl 6 receiving the pump impeller 7. Such impeller consists of: a cylindrical shroud disk or plate 8 projecting radially from the impeller hub 9 fixed to the drive shaft; the primary pumping vanes or blades 10 projecting downward from the shroud plate; and vanes or ribs 11 projecting upward from the upper face of the shroud plate opposite the primary pumping blades 10.

The bottom of the pump bowl is closed by an endplate 13 clamped or bolted to the bottom of the pump casing and having inlet apertures 14 which, as best seen in FIG. 2, are arcuate and concentric with the axis of rotation of the drive shaft and the impeller.

An optional addition for a pump of the type shown in FIG. 1 and FIG. 2 is a disintegrater or booster propeller 15 located opposite the end plate 13 from the impeller 7. The booster propeller 15 has blades 16. Also, the impeller vanes 10 may have sharpened edges cooperating with edges of the inlet apertures 14 and, particularly, with "cutter bars" 14' formed as part of the endplate 13 and extending radially across the intake area of the plate.

In general, rotation of the impeller creates suction at the intake side of the endplate for drawing a liquid or slurry into the pump casing. The slurry is accelerated outward and circumferentially to an outlet 18 that extends generally tangentially to the remainder of the pump casing.

Figure 3:
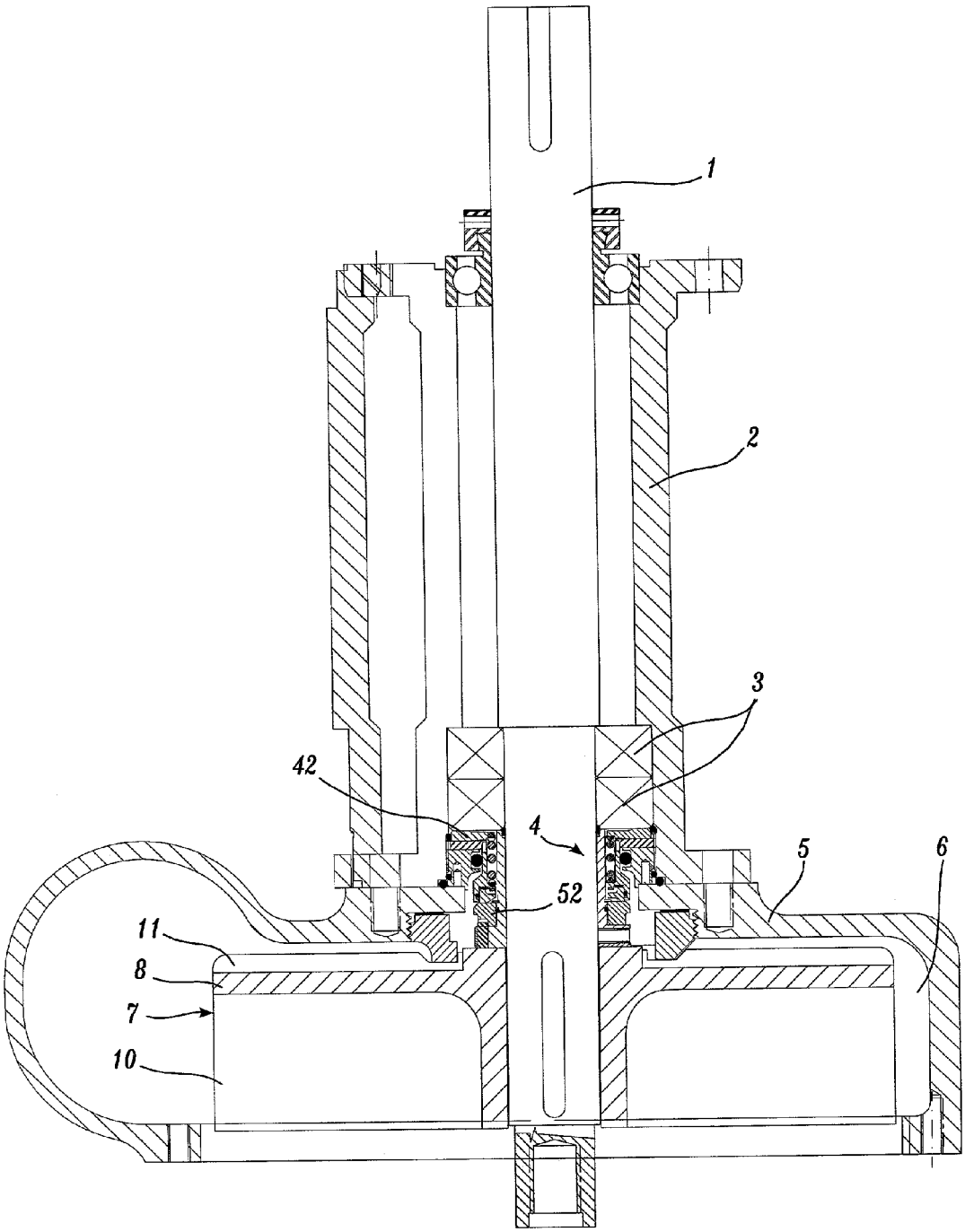
FIG. 3 is an enlarged axial section of a centrifugal pump having an improved seal structure in accordance with the present invention.

FIG. 3 is a vertical section of a pump of the general type shown in FIGS. 1 and 2 with some parts deleted (including the bottom endplate which would close the open bottom of the pump bowl 6). As described above, the upright drive shaft 1 extends through a column 2 and is supported by thrust bearings 3. An improved seal 4 closes the top portion of the pump casing 5 to which the lower end of the column 2 is bolted. The pump bowl receives the impeller 7 which includes the radial shroud disk or plate 8, primary pumping vanes or blades 10, and vanes or ribs 11 at the top of the shroud plate. In the design of FIG. 3, special upper cutters are provided to cooperate with the upper vanes 11. Nevertheless, it has been found that material may work its way into the area of the seal 4. Tough, stringy material may become wrapped around the seal area and affect operation of the seal and shorten its effective life.

Figure 5:
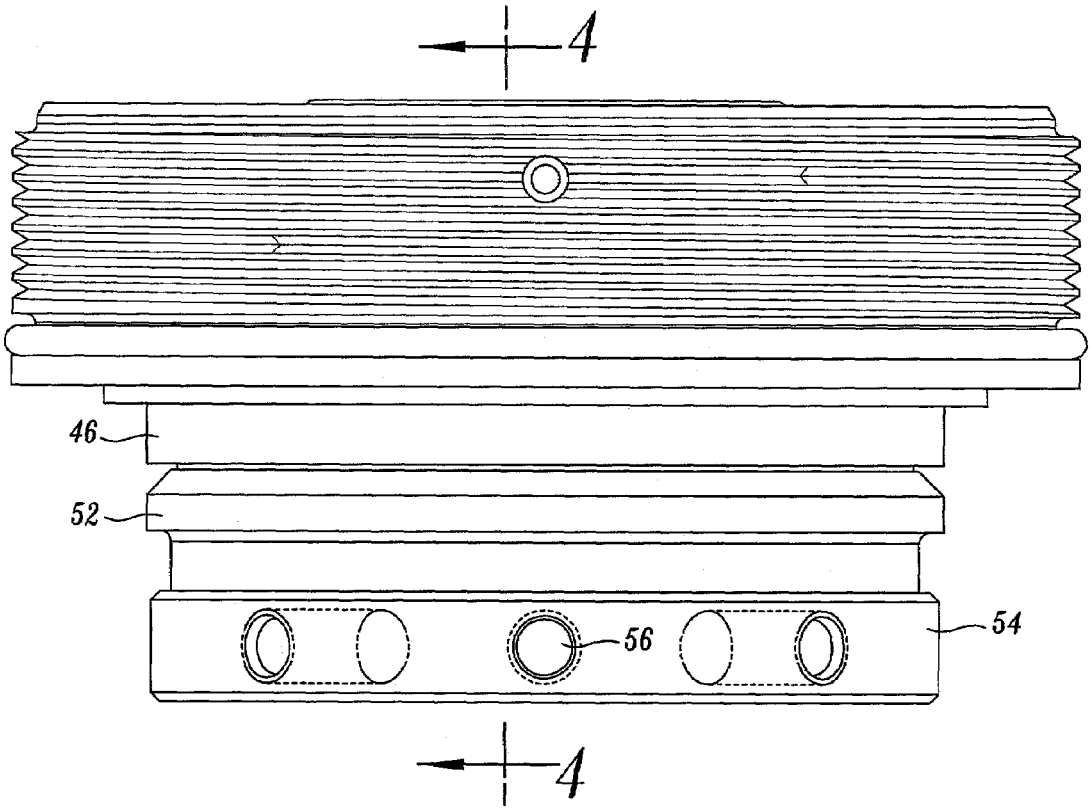
FIG. 5 is a side elevation thereof.
Figure 4:
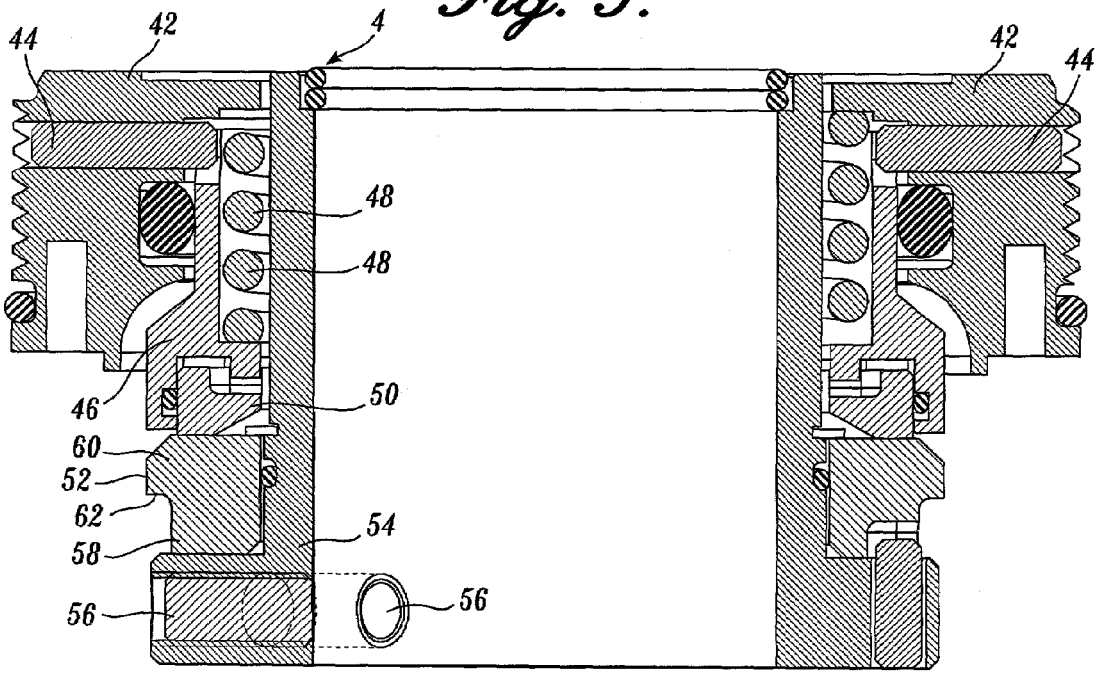
FIG. 4 is an enlarged axial section of such seal structure.
Figure 4A:
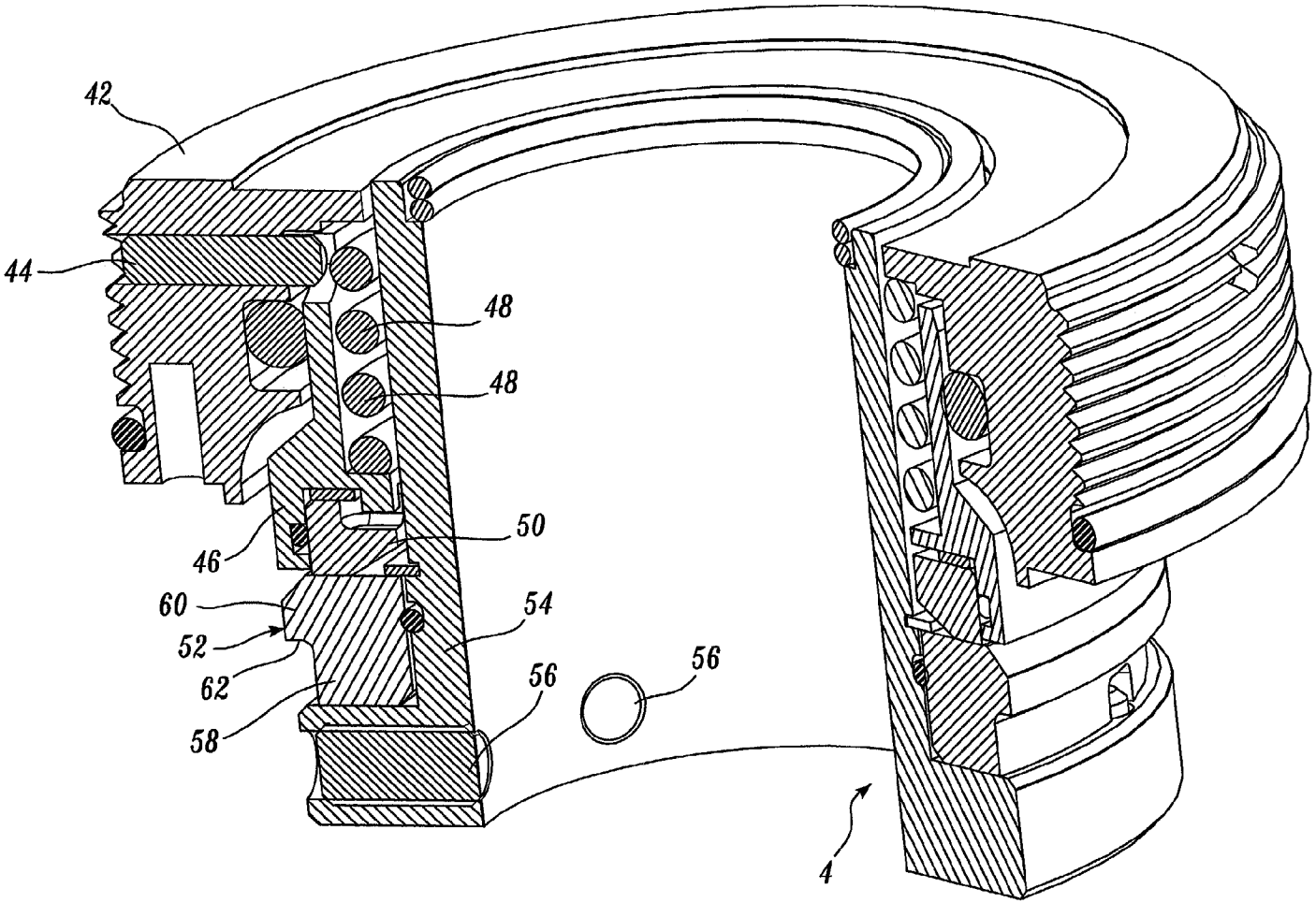
FIG. 4A is an enlarged top perspective of such seal structure.

The primary components of the seal 4 are best seen in FIG. 4 which is a vertical section along line 4—4 of FIG. 5, and FIG. 4A. The seal 4 includes an upper one-piece gland 42 having external threads for mounting of the gland in the lower portion of the column 2 (which, in some applications, could be the upper portion of the pump casing). Pins 44 couple the gland 42 to the stator component 46 which encircles the drive shaft and which is biased downward by a helical compression spring 48. The bottom portion of the stator carries the stationary seal face member 50. The rotating seal face component 52 is carried by a sleeve 54 which is coupled to the drive shaft such as by set screws 56.

The rotating seal component 52 has an upper face that mates with the bottom face of the stator component. In addition, the lower portion 58 of the rotating seal component 52 is of an outside diameter substantially less than the upper portion 60, forming an abrupt shoulder 62 that faces downward. In the embodiment shown in FIGS. 3, 4 and 4A, the shoulder extends radially outward a distance less than the distance between the outer periphery of the rotating seal component 52 and the adjacent edge of the opening through the pump casing. Preferably, the radial extent of the shoulder is kept at no greater than one-half the distance from the outer periphery of the rotating seal component and the adjacent edge of the casing opening to prevent chunks, lumps, grit, or stringy or other tough material from becoming lodged between the rotating seal component and the casing.

It has been found that by including the shoulder 62 on the rotating seal component 52 there is a lesser chance of wrapped material collecting in the area of the abutting seal faces. It is believed that this is because the shoulder prevents wrapped material from climbing axially upward along the rotating seal component. Once material wraps in the joint between the two seal faces, leakage may occur, causing seal failure. For pumps with rotating seal components not having a shoulder, such leakage and failure is more likely to occur than for pumps having rotating components provided with the shoulder.

As noted above, pumps of the type with which the present invention is concerned may be used for pumping slurries and/or chopping solid or semi-solid materials carried by the liquid being pumped. In this regard, the bottom edges of the primary pumping impeller vanes or blades 10 may cooperate with the edges of the intake apertures 14 and cutter bars 14'. In addition, in the past the inner face of the endplate 13 has been provided with short radial or angled ribs that project into the pump bowl. The bottom edges of the impeller blades or vanes 10 can be recessed slightly to accommodate the ribs, the intent being to provide an abrupt chopping action as the blades or vanes sweep over the ribs.

Figure 8:
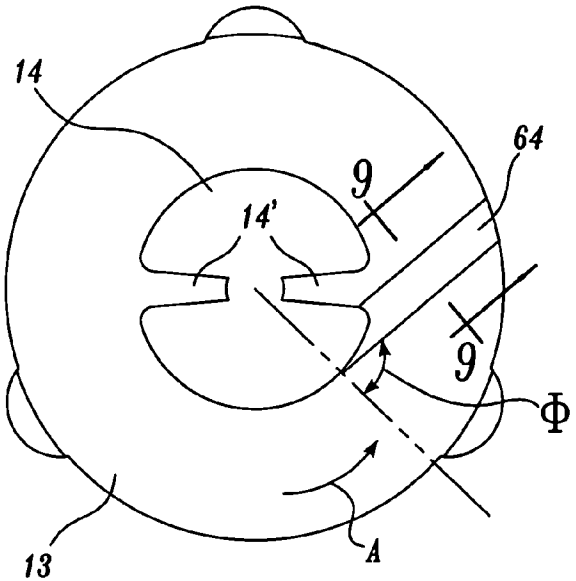
FIG. 8 is a top plan thereof.
Figure 7:
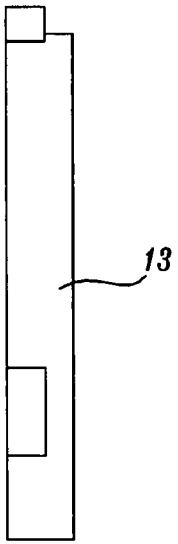
FIG. 7 is a side elevation thereof.
Figure 6:
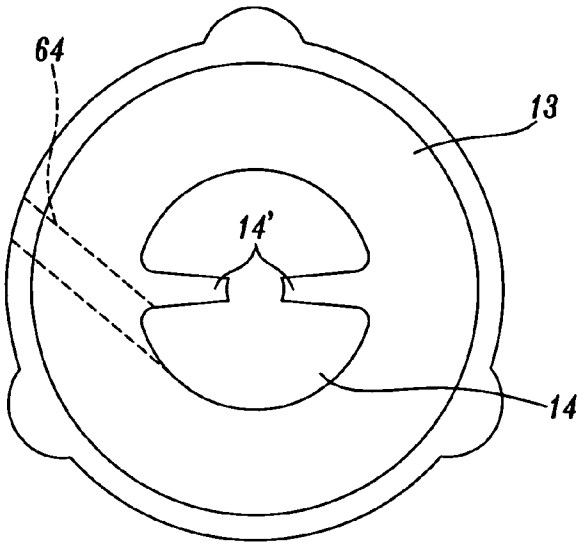
FIG. 6 is a bottom plan of an improved intake plate for a centrifugal chopper pump of the general type shown in FIG. 1.
Figure 9:
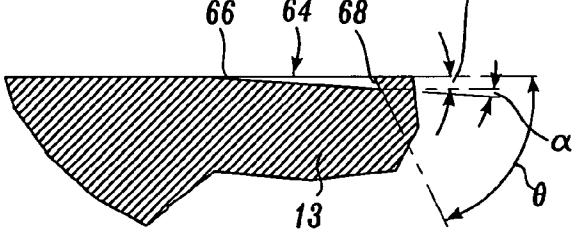
FIG. 9 is an enlarged fragmentary section along line 9—9 of FIG. 8.
Figure 10:
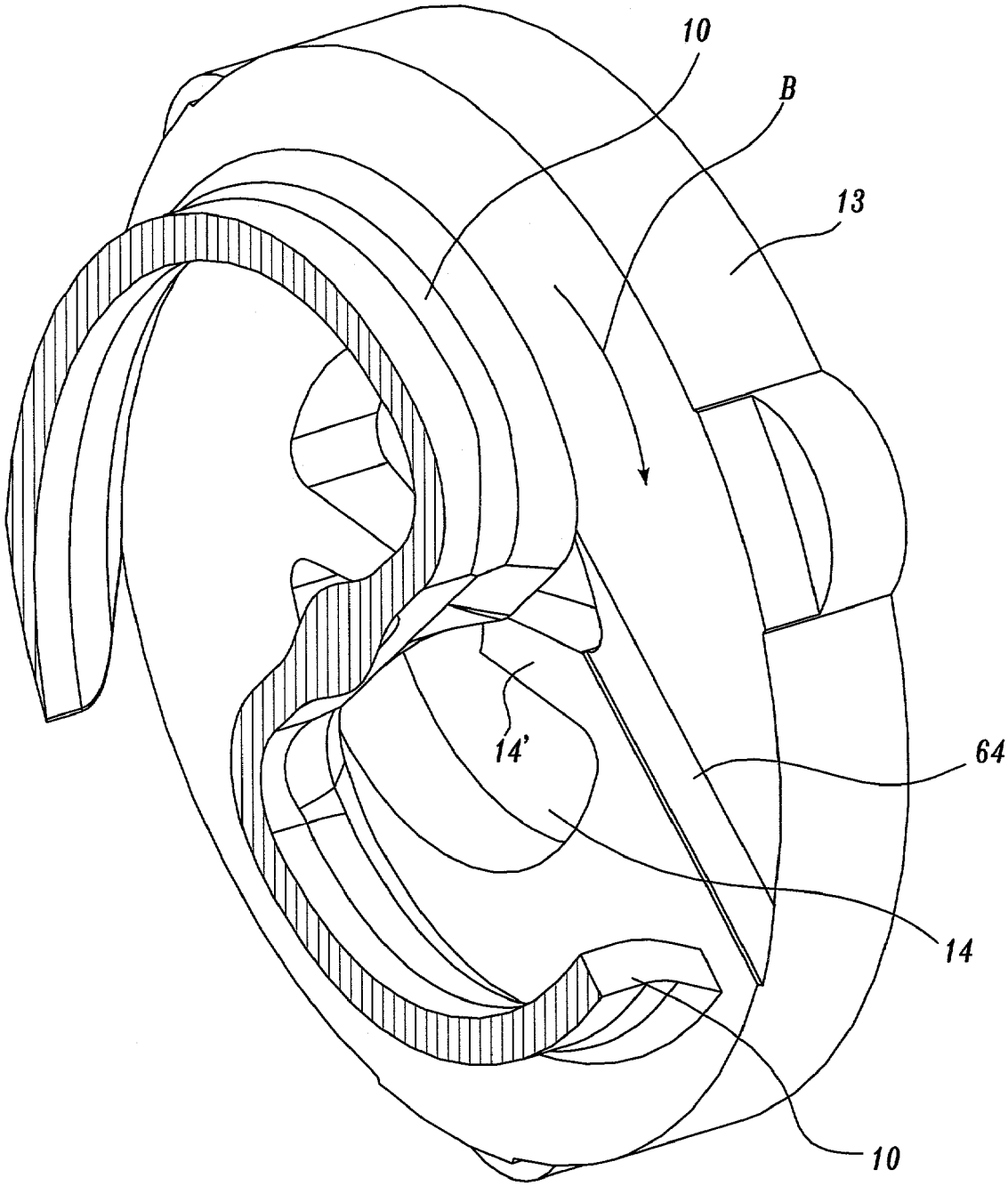
FIG. 10 is a diagrammatic top perspective of pump blades or vanes and the interior side of an intake plate in accordance with FIGS. 6–9.

An alternative construction for the endplate 13 is shown in FIGS. 6–10. Endplate 13 has the usual arcuate intake apertures 14 and radial cutter bars 14'. The bottom plan of FIG. 6 shows the outer face of the endplate 13 as being essentially flat and smooth. The top plan of FIG. 8 shows a shallow groove 64 which is elongated but not in a radial direction. Rather, the groove extends at an angle $\phi$ to a radius, from its inner edge to its outer edge in a forward direction with reference to the direction of impeller rotation (represented by arrow A in FIG. 8). The cross-sectional shape of the groove 64 is shown in FIG. 9. The trailing edge 66 of the groove (i.e., the edge first contacted by a rotating impeller blade) is gently tapered into the plate at a very small acute angle $\alpha$, such as three degrees, preferably no more than ten degrees, to avoid creating excess turbulence, the base of the groove forming a gentle flat ramp. The leading edge 68 (i.e., the edge last contacted by the rotating impeller) is angled sharply upward. Preferably, the leading edge is undercut at a large acute angle $\theta$, such as 60 degrees, preferably more than 45 degrees and less than 90 degrees. In a typical pump, the maximum depth D of the groove can be 0.020–0.100 inch, with the groove extending completely across the face of the end plate 13 from a trailing corner of one of the arcuate intake openings 14 to the outer margin of the end plate, or at least to the peripheral margin of the end plate where it attaches to the pump casing. FIG. 10 shows the relationship of the internal groove 64 cut in the intake plate 13 to the impeller blades 10 (the shroud plate being cut away for ease of illustration) in the case of an impeller rotating in the direction indicated by the arrow B.

Experience has shown that if the impeller vanes are allowed to run against a smooth, flat, unbroken surface, fibrous material will build up between the bottom of the impeller vanes and the endplate. Providing raised ribs helps eliminate this problem, but the shallow relief cut into the impeller blades to pass over the raised ribs causes a loss in pump head due to back leakage in the pump. Using the "inset and angled ramp internal cutter" groove 64, the impeller vanes are formed with flat bottoms so that very close clearances (around 0.005–.0015 inch) can be achieved to cut effectively and to achieve considerably better pumping efficiencies.

Another consideration for centrifugal pumps of the type with which the present invention is concerned is that such pumps rely on atmospheric pressure to push material into the pump's low pressure area. This low pressure area is created inside the pump inlet toward the center of the rotating impeller. Centrifugal pumps are limited by whatever absolute pressure is available at the pump inlet. Each pump design requires a certain minimum amount of absolute pressure at the pump suction-pressure above the vapor pressure of the pumped liquid to be able to generate its normal head and flow characteristics. Any pressure less than this minimum causes the pump to cavitate and lose discharge head. The pressure available is referred to as "Net Positive Suction Head Available" (NPSHA) and the minimum NPSH required to allow the pump to work as rated by the manufacturer is "Net Positive Head Suction Head Required" (NPSHR). The lower the NPSHR of any given pump, the better able that pump is to effectively pump hot water (such as condensate pumps in a power plant) or to provide a high suction lift to the pump (as required in self-priming pumps).

Figure 11:
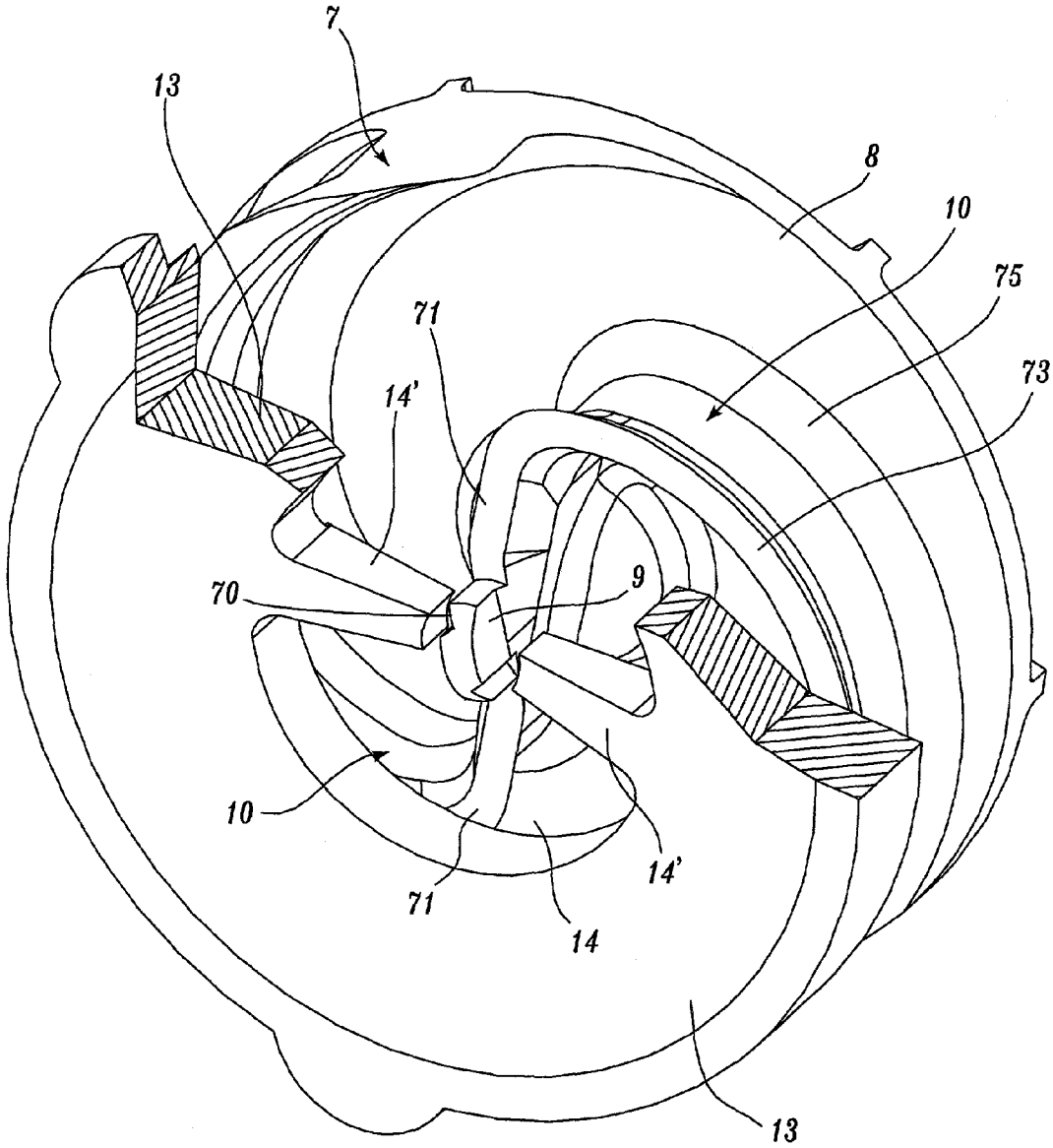
FIG. 11 is a somewhat diagrammatic bottom perspective of a pump impeller having an improved vane structure in accordance with the present invention.

Centrifugal pumps are normally designed with an unobstructed suction opening, which promotes a lower NPSHR. Some chopper pumps have significant suction blockage (i.e., stationary cutter bars extending diametrically across the suction opening, plus a hub at the center of the impeller to support the cutting/pumping blades). This blockage results in a pump requiring more NPSH than any standard centrifugal pump of equivalent hydraulic size. FIG. 11 illustrates modifications including a particular impeller vane shape that helps to minimize suction opening blockage and thus reduces NPSHR. The majority of the portion of the impeller vane which is exposed in the arcuate intake or suction openings 14 extends radially (rather than at an angle or in a spiral) from the impeller hub (the radial portion is identified as 71 in FIG. 11). Eliminating the angled or spiraled portion in this area results in blocking less of the intake opening. In addition, the impeller hub 9 is tapered from the back or shroud plate 8 down toward the inlet opening so that only the width of the impeller blade blocks the inlet. At or near the outer peripheral edge of the suction opening, the vanes are swept back into a curve described by a logarithmic spiral, with either a constant or varying vane angle and continue to the outside diameter of the impeller (this outer section is identified as 73 in FIG. 11). The entire vane, both the inner radial portion 71 and the outer curved portion 73, can include a forward inclined leading edge 75, which facilitates cutting against the stationary cutter bars 14' and any cutter provided (including an internal cutter recess as described above) on the inside surface of the end plate.

In addition, a "cutting nose" can be provided on the impeller hub with sharpened cutting teeth 70 on its outer diameter to cooperate with the center or inner edge portions of the cutter bars 14'. Close clearances are required for this cutting to be effective. The nose has a rounded exposed portion to keep material from collecting on it. The purpose of the cutting nose is to prevent intake opening blockage. Certain materials, such as rags, may lay over the outside of the stationary shear bars 14' and start blocking flow into the pump, unless the cutting nose is used.

Figure 12:
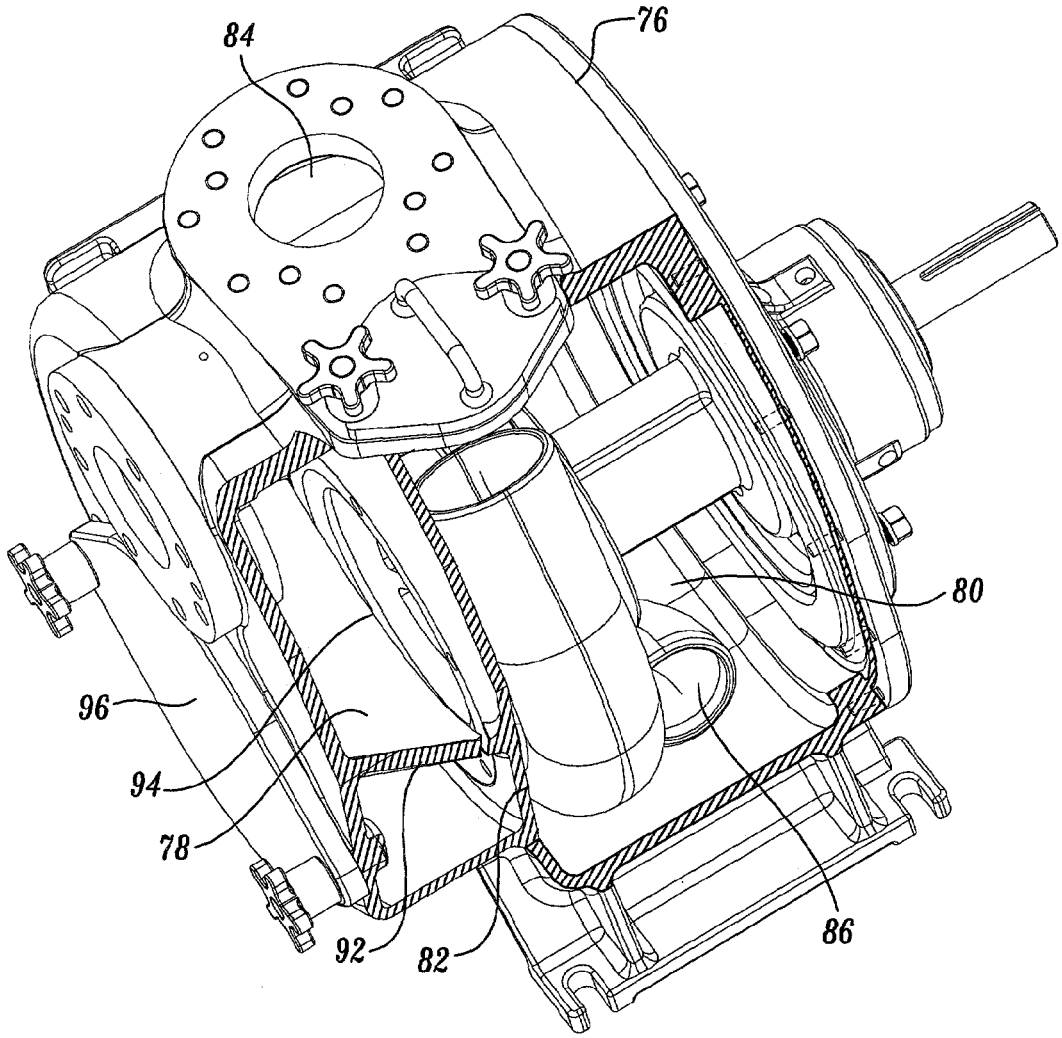
FIG. 12 is a top perspective of a self-priming pump in accordance with the present invention, with parts broken away.
Figure 13:
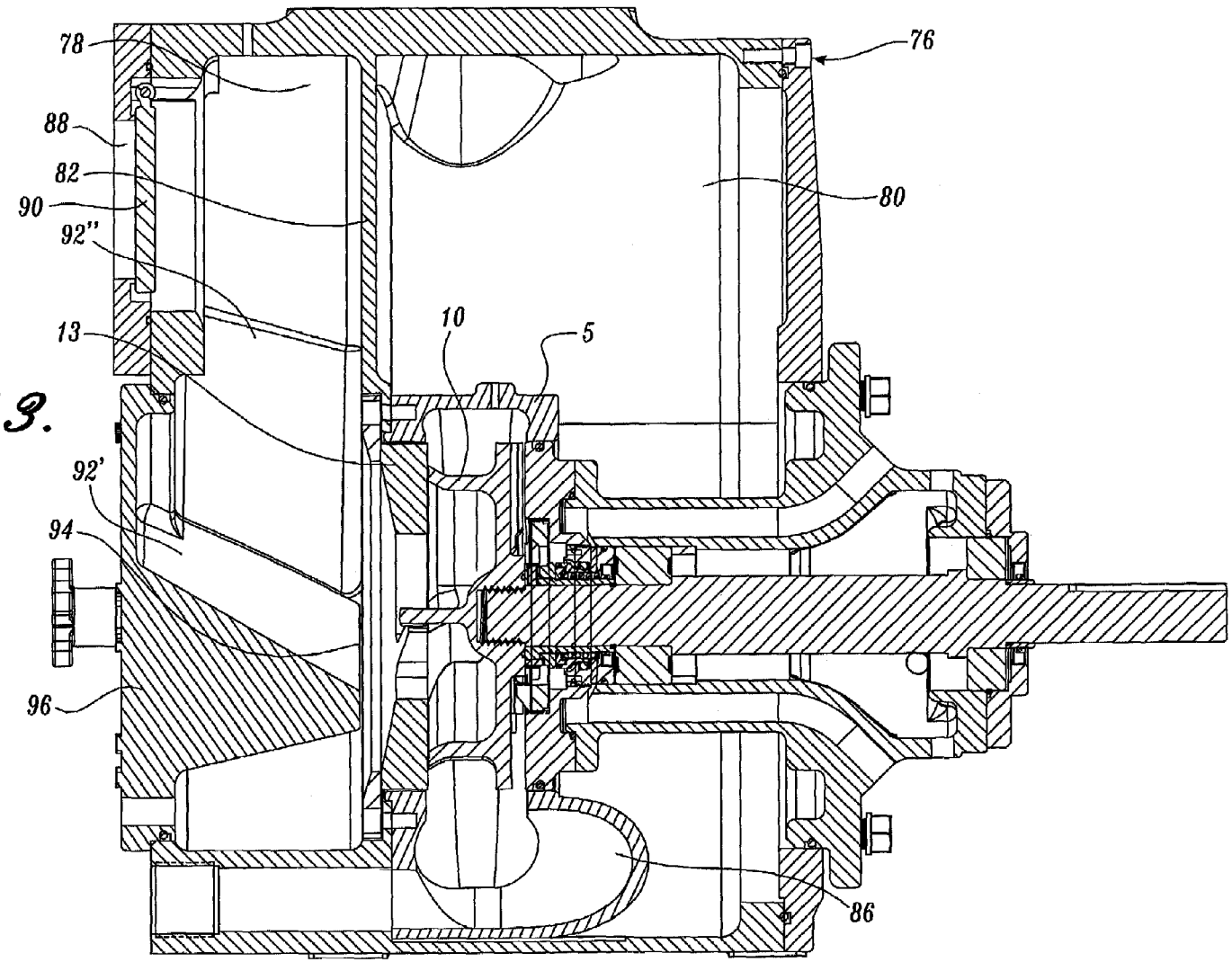
FIG. 13 is a side elevation thereof with parts shown in section.

Another aspect with which the present invention is concerned is adapting a pump of the general type described above into a self-priming pump. FIG. 12 (perspective view) and FIG. 13 (vertical section) illustrate these changes diagramatically. With reference to FIG. 13, the centrifugal pump unit including the pump casing 5 and intake formed by end plate 13 is mounted in a two-compartment housing 76. In each of FIG. 12 and FIG. 13, the housing compartment 78 at the left is the suction chamber and the housing compartment 80 at the right is a discharge chamber (in FIG. 12 part of the outer wall of the housing 76 is broken away). The center wall 82 of the housing between the suction chamber and the discharge chamber is formed with an opening to accommodate the endplate 13 of the pump through which material is drawn inward. The discharge port 84 of the pump is shown in FIG. 12.

At the bottom of the pump casing, an additional port 86 is provided to communicate with the housing discharge chamber, namely, a "reprime port". This provides for open communication between the discharge chamber and the interior of the pump casing 5.

The suction chamber 78 has an upper suction port 88 with a check valve assembly 90. In general, the pump housing 76 is designed such that it will always retain a proper amount of water required for repriming of the pump. After the pump shuts down and the water in the suction line is allowed to drain back into the sump, the pump reprimes as follows:

When the pump starts up it draws as much water as possible from the suction side of the housing. This water is combined with the water in the discharge side of the housing and recirculated through the pump casing by way of the reprime port 86. This recirculation of water through the pump causes any air in the suction line to be drawn into the pump, mixed with the water being recirculated, and then allowed to separate from the water (in the discharge chamber) as it is waiting to be recirculated through the pump casing again. As the air is drawn out of the suction line, a vacuum is created and water from the sump is forced into the suction line by atmospheric pressure. Once the suction line is completely filled, the pump housing begins filling and forces any remaining air out of the discharge chamber. At this point, the pump is completely primed.

For best pumping efficiency, it is believed that gentle changes in the direction of water directed in the suction passageways are desirable. However, when gentle bends are inserted into the suction side of the housing to effect the more gentle changes in flow direction, the bends and fillets in the suction passageways use up some of the suction compartment volume which is needed to store water for effective pump priming. This problem has been solved by providing an angled flow deflector 92 in the suction compartment. Preferably, the flow deflector has a downward inclined, generally semi-cylindrical upper surface that leads from below the suction port 88 to an area adjacent to the pump inlet. However, the inner edge 94 of the deflector stops short of the pump inlet, such that the pump may access water stored below the deflector. The deflector resembles a 180 degree scoop with a flat forward edge adjacent to but spaced from the pump inlet. In the illustrated embodiment, a large clean-out plate 96 is provided at the upright side of the suction chamber 78 opposite the pump intake, and the central portion 92' of the scoop is mounted on the clean out, whereas the side portions 92" of the scoop are mounted to the stationary walls of the suction chamber. The side portions and central movable portion of the scoop form smooth continuations of each other when the clean-out is inserted. Thus, the deflector scoop has no exposed edges where stringy materials or lumps or chunks of solid or semi-solid material can become trapped to block flow to the pump. The suction side flow deflector with an access port (i.e., the gap between the inner edge of the deflector and the pump inlet) allows the pump to use stored water below the deflector and provides a good compromise between achieving good pump efficiency and good pump priming capabilities.

Figure 14:
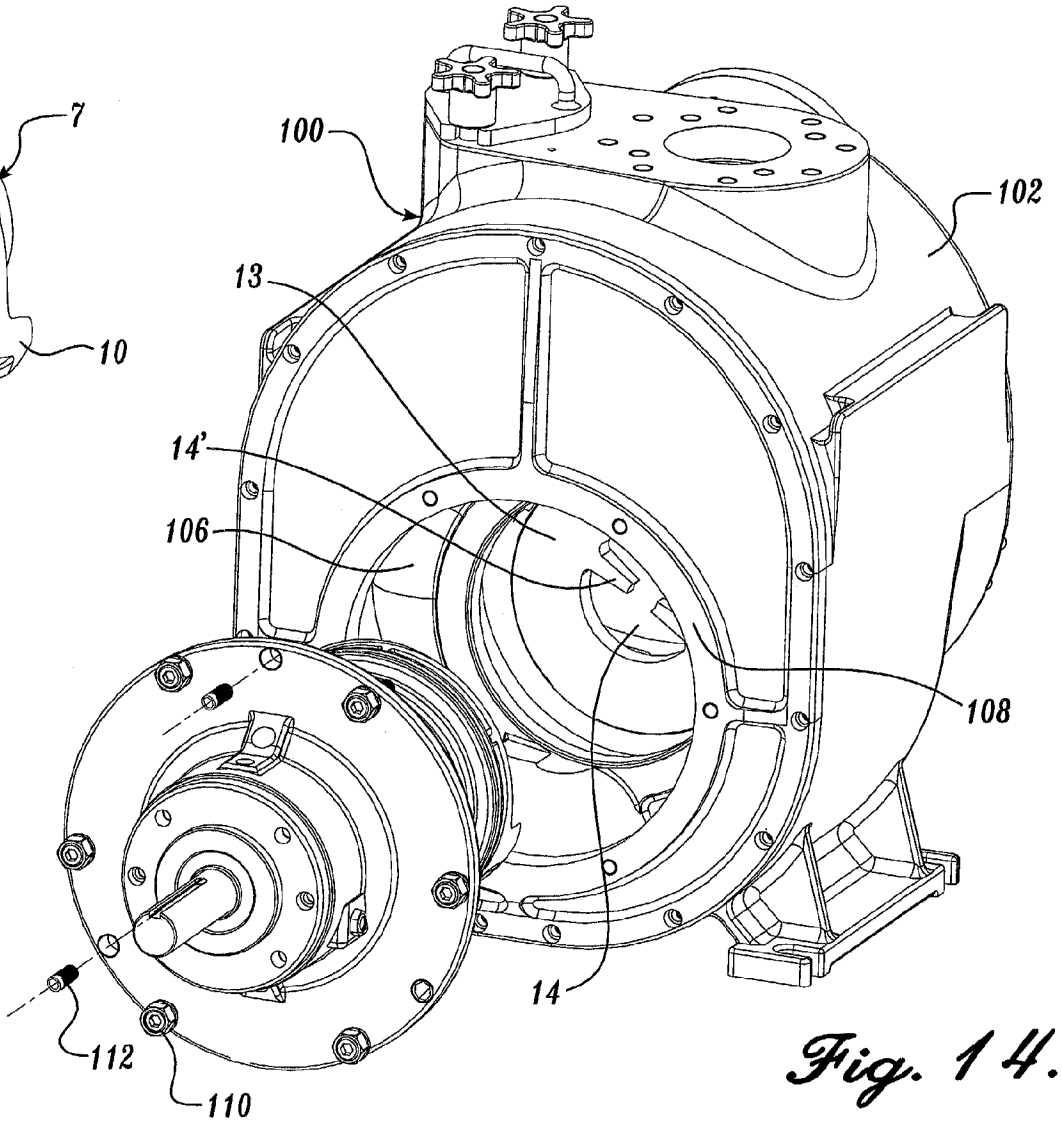
FIG. 14 is a perspective of a modified pump structure permitting external adjustment of the impeller-intake plate clearance, with parts shown in exploded relationship.
Figure 15:
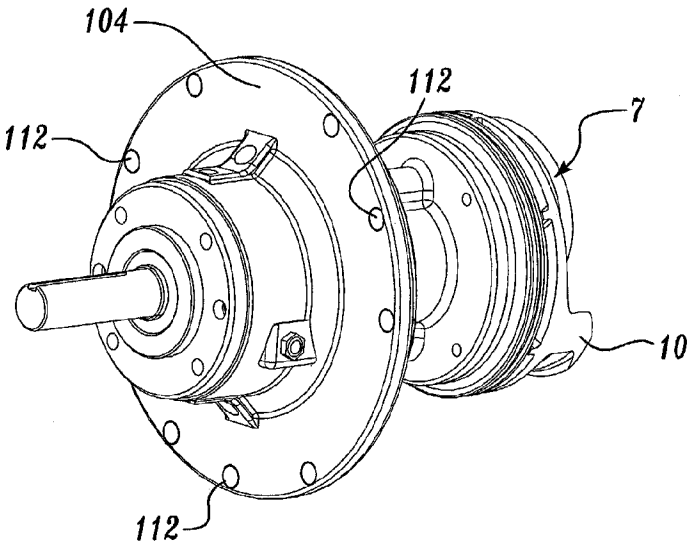
FIG. 15 is a perspective view of one assembly thereof.
Figure 16:
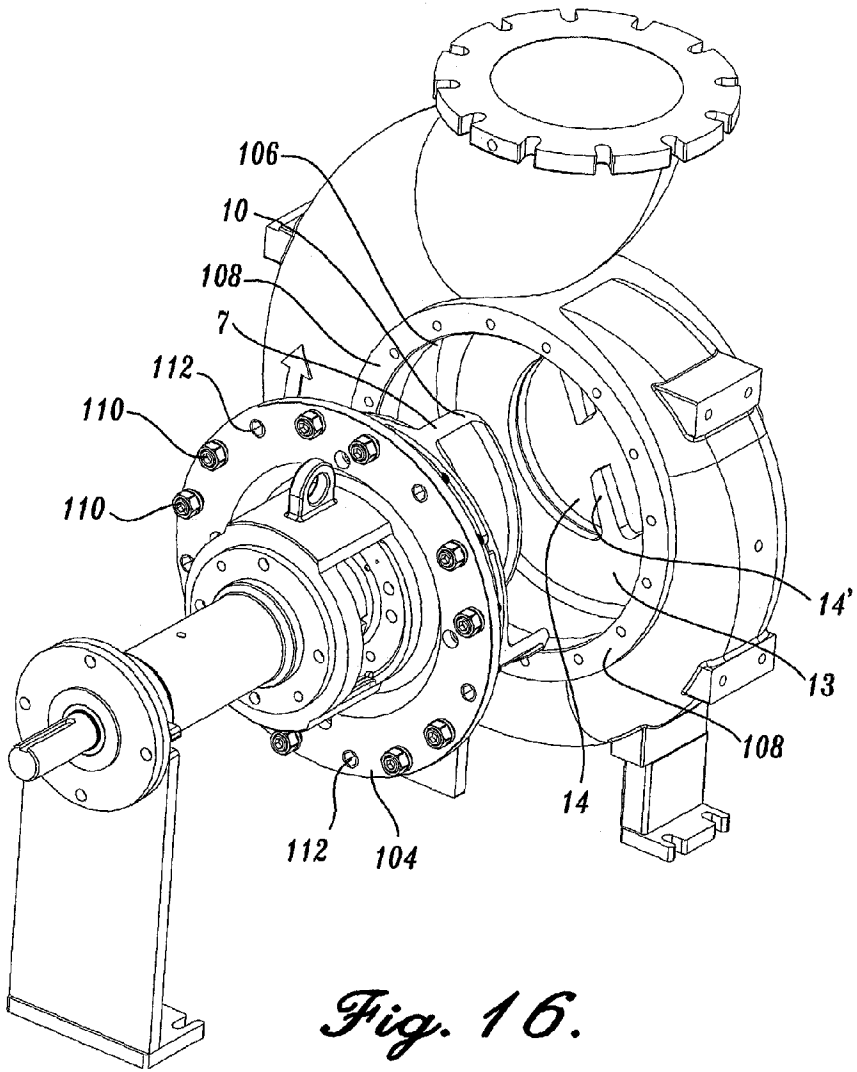
FIG. 16 is a top perspective of a modified pump having external adjustment mechanism similar to that of the pump of FIGS. 14 and 15, with parts shown in exploded relationship.

FIG. 14 illustrates a self-priming pump 100 of the general type shown in FIGS. 12 and 13 partially disassembled. The pump impeller 7 and all rotating components can be mounted or removed from the pump housing 102 by uncoupling a back plate 104 which fits in a rear opening 106 of the housing. This assembly is shown in FIG. 15. Returning to FIG. 14, the pump intake plate 13 is mounted separately in the housing 102. In one known construction, shims are placed between the margin 108 of the housing opening 106 and the back plate 104 which carries the rotating pump components to adjust the clearance between the impeller blades and the intake plate 13, particularly the cutter bars 14' of the intake plate. With reference to FIG. 16, a similar construction can be provided for the more traditional pump design that does not include the enlarged housing of the self-priming pump. In that case, the intake plate 13 is mounted to the casing 5, and the rear side of the casing has the opening 106 for the back plate 104 which carries the rotating pump components, including the impeller 7.

In accordance with the present invention, small adjustments can be made in the clearance between the impeller blades and the interior of the intake plate 13 without completely disassembling the pump. Rather, the clamp bolts 110 which secure the back plate 104 to the pump housing 102 or casing 5 are loosened, and the distance between the inside face of the back plate and the outside face of the margin 108 of the opening 106 is adjusted by turning set screws 112. In this construction, preferably at least three set screws are provided spaced uniformly around the circumference the back plate 104. The set screws are threaded in the back plate and have exposed ends that bear against the housing or casing margin 108 at locations between adjacent clamp bolts 110.

Figure 18:
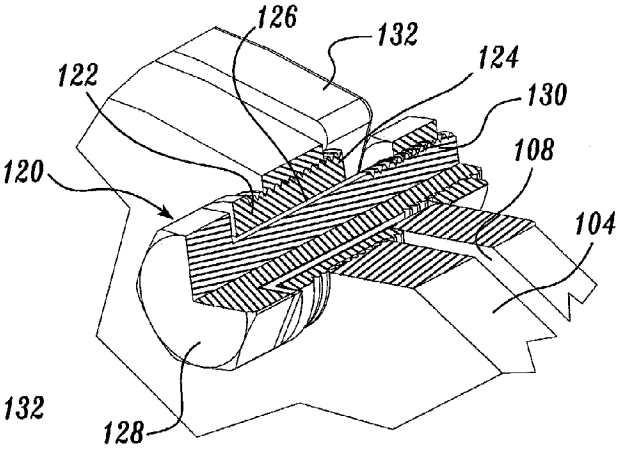
FIG. 18 is an enlarged fragmentary perspective of a part thereof.
Figure 17:
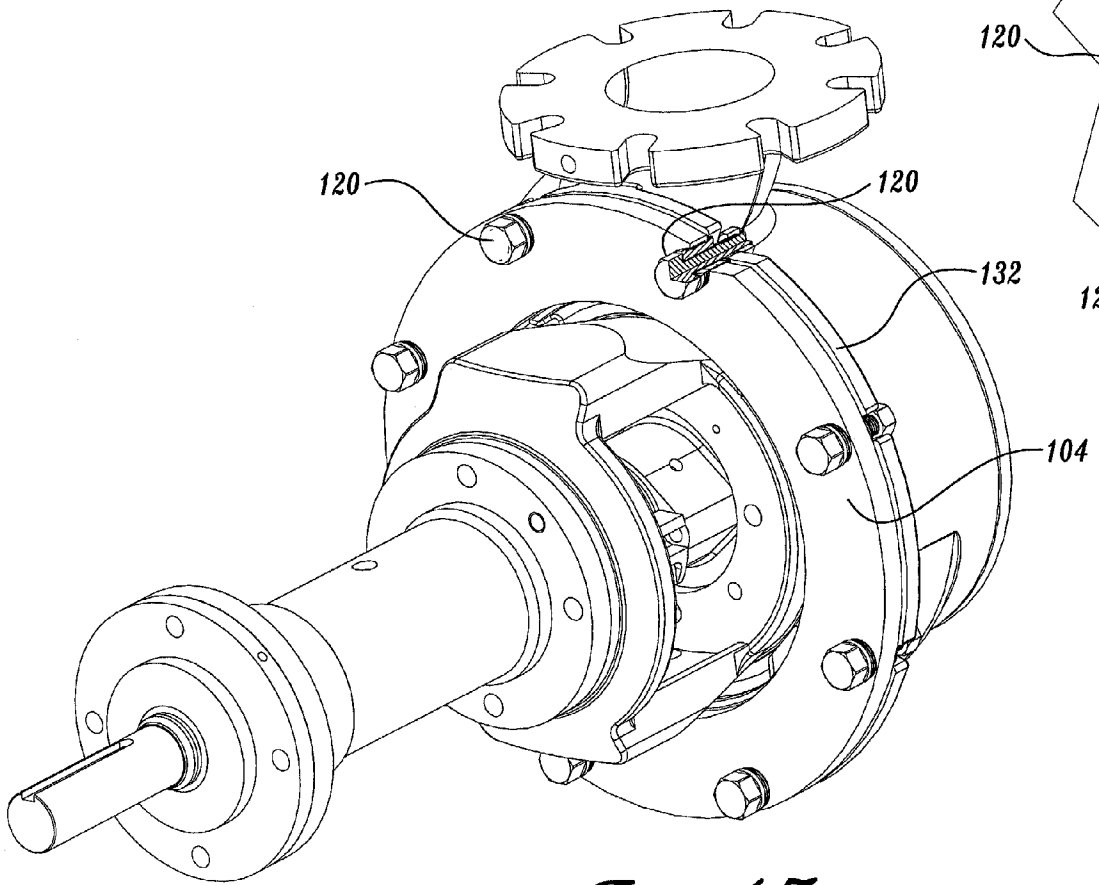
FIG. 17 is a perspective of another modified pump having external adjustment mechanism.

With reference to FIGS. 17 and 18, the adjustment screws and clamp bolts can be combined in one unit 120, the details of which are best seen in FIG. 18. Larger adjustment screws or bolts 122 are threaded into the back plate 104 and have inner ends 124 that bear against the marginal portion 108 of the pump casing flange adjacent to the opening which is closed by the back plate. Each adjustment bolt 122 has a central bore 126 through which a clamp bolt 128 extends, including its threaded inner end portion 130 which can be screwed into the pump casing flange 132 or an inner nut. In this construction, the clamp bolts 128 can be unscrewed sufficiently to allow the adjusting screws or bolts 122 to be turned for moving their inner ends 124 in or out, thereby moving the impeller of the pump relative to the intake plate. When a desired position has been reached, the clamp bolts 128 are tightened to lock the assembly in position. If the clearance is incorrect, or if, for example, the impeller blades become worn over time, the clearance can easily be adjusted by unscrewing the clamp bolts and turning the adjusting bolts in the appropriate direction, followed by tightening the clamp bolts to lock the assembly in position again.

While the preferred characteristics of the invention have been described and illustrated, it will be appreciated that various changes can be made therein without departing from the spirit and scope of the invention.

The embodiments of the invention in which an exclusive property or privilege is claimed are defined as follows:

1. A centrifugal pump having an impeller rotatable about an axis, such impeller having a plurality of generally radially extending vanes, and a pump casing including a bowl receiving the impeller and having an inlet side for intake of material into the pump bowl and a rear side opposite the inlet side, an intake plate mounted at the inlet side of the pump casing and having an inlet aperture, the impeller vanes having edges closely adjacent to the inner surface of the intake plate facing the pump bowl, such inner surface of the intake plate having a shallow recess extending generally obliquely relative to a radius from the axis of rotation of the impeller, the shallow recess having an abrupt edge for assisting in cleaning the impeller vanes of material as the impeller rotates and the vanes pass along the inner surface of the intake plate, the abrupt edge of the recess being undercut at a large acute angle.

2. The pump defined in claim 1, in which the large acute angle is more than 45 degrees.

3. The pump defined in claim 1, in which the large acute angle is about 60 degrees.

4. The pump defined in claim 1, in which the recess extends at an angle to a radius from an inner edge of the recess to an outer edge of the recess in a forward direction with reference to the direction of rotation of the impeller.

5. The pump defined in claim 1, in which the recess has a trailing edge gently tapered into the intake plate at a very small acute angle.

6. The pump defined in claim 5, in which the small acute angle is within the range of 3 degrees to 10 degrees.

7. The pump defined in claim 4, in which the base of the groove forms a flat ramp.

8. The pump defined in claim 1, in which the maximum depth of the recess is 0.020 to 0.100 inch.

9. The pump defined in claim 1, in which the recess extends completely across the face of the intake plate from the inlet aperture to the outer margin of the plate.

* * * * *